US005302167A

United States Patent [19]

Kley et al.

[11] Patent Number: 5,302,167

[45] Date of Patent: Apr. 12, 1994

[54] EMBOSSING DISPENSER ROLL TRANSFER ASSEMBLY

[75] Inventors: Richard D. Kley, West Chester, Pa.; Dean H. Heili, Manitowoc, Wis.

[73] Assignee: Scott Paper Company, Delaware County, Pa.

[21] Appl. No.: 79,850

[22] Filed: Jun. 23, 1993

Related U.S. Application Data

[63] Continuation of Ser. No. 738,078, Jul. 30, 1991, abandoned.

[51] Int. Cl.[5] ..... B31B 1/36

[52] U.S. Cl. ..... 493/400; 242/55.3; 226/91; 312/34.22

[58] Field of Search ..... 493/395, 396, 400–403; 242/55.3, 55.53; 226/91, 92, 127, 129; 312/34.19, 34.22

[56] References Cited

U.S. PATENT DOCUMENTS

| | | | |
|---|---|---|---|
| 3,628,743 | 12/1971 | Bastian | 242/55.3 |
| 3,917,191 | 11/1975 | Graham, Jr. et al. | 242/55.3 |
| 4,010,909 | 3/1977 | Bastian | 242/55.3 |
| 4,067,509 | 1/1978 | Graham, Jr. et al. | 242/55.3 |
| 4,165,138 | 8/1979 | Hedge et al. | 242/55.3 |
| 4,403,748 | 9/1983 | Cornell | 242/55.53 |
| 4,487,375 | 12/1984 | Rasmussen et al. | 242/55.3 |
| 4,756,485 | 7/1988 | Bastian et al. | 242/55.3 |
| 4,807,824 | 2/1989 | Gains et al. | 242/55.3 |
| 5,061,232 | 10/1991 | Bloch et al. | 493/395 |

FOREIGN PATENT DOCUMENTS

92696A1 3/1990 European Pat. Off. .

*Primary Examiner*—Bruce M. Kisliuk
*Assistant Examiner*—Eileen P. Morgan
*Attorney, Agent, or Firm*—M. G. Bocchetti; J. W. Kane, Jr.

[57] ABSTRACT

Disclosed is transfer apparatus for use in an embossing dispenser capable of sequentially dispensing primary and secondary rolls of a sheet material. The transfer apparatus includes pivotally mounted transfer linkage which supports a primary roll contacting surface. Bar means attached to the transfer linkage has a comb projecting therefrom with a wing member extending from each end of the bar member. The transfer linkage is biased for rotational movement to maintain the primary roll contacting surface in contact with the primary roll as the primary roll is depleted. This biasing simultaneously rotates the bar means toward the embossing rollers. As the primary roll nears exhaustion, the wing members engage one of the embossing rollers to thereby position the comb means such that it partially invades the grooves of the embossing roller thereby moving the tail of the secondary roll into contact with one of the knuckled embossing rollers in close proximity to the nip such that the tail of the secondary roll is engaged by the knuckles of the embossing rollers and drawn through the nip. The wing members ensure that the comb means so positions the tail of the secondary roll without the comb interfering with either of the embossing rollers.

18 Claims, 4 Drawing Sheets

240
226
200
240
232
238
222
250
248
236
228
226
234
224
256
252
244
220
216
256
214
242
204
230
246
206
62
250
210
70
266
218
254
72
50
248
244
60
112R
212
208
48
204
202
66
112F
80
101R
112R
30R
78
52
56
44
50
30F
74
101F
112F
64
54
80
40
78
46
68
66
132
42

44
58
36
38
132

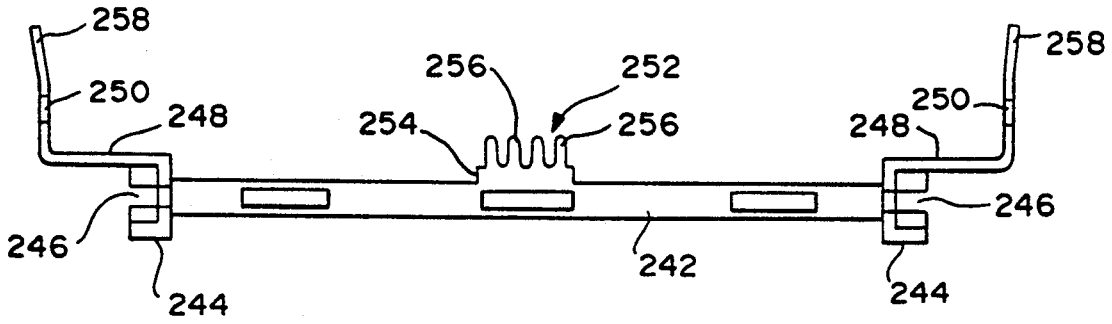
FIG. 2
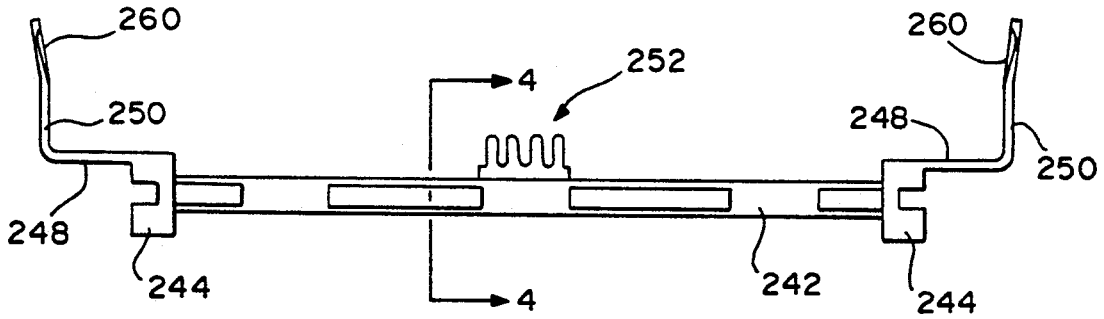
FIG. 3
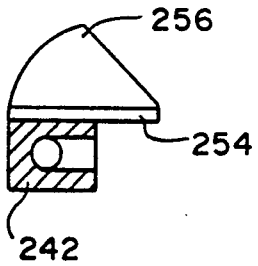
FIG. 4
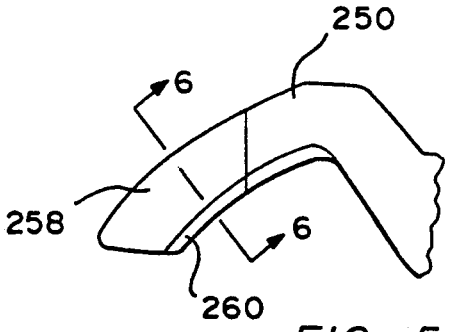
FIG. 5
FIG. 6
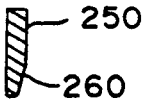

EMBOSSING DISPENSER ROLL TRANSFER ASSEMBLY

This application is a continuation of application Ser. No. 07/738,078 filed Jul. 30, 1991, now abandoned.

BACKGROUND OF THE INVENTION

1. Field of the Invention

The present invention relates generally to embossing dispensers for dispensing multiple rolls of rolled paper products and more particularly, to means for transferring the tail of the secondary roll into the nip and, therefore, a dispensing position when the primary roll is exhausted.

2. Brief Description of the Prior Art

A variety of dispensing cabinets for sequentially dispensing two rolls of sheet material such as paper towel are known in the prior art. Upon depletion of sheet material from one roll, dispensing automatically begins from the second roll. These dispensing cabinets typically include a pair of rollers forming a nip through which the sheet material is passed. These feed rollers are usually attached to a crank or a lever which is used to drive one or both of the rollers so as to draw a portion of the sheet material therethrough. Initially, the sheet material from one roll is placed into the nip and, as the initial roll approaches exhaustion, the leading end of the sheet material from the second roll is transferred into the nip. In such manner, dispensing of the sheet material from the second roll is commenced.

An example of such a prior art dispenser is U.S. Pat. No. 3,628,743 to Bastian. Such dispenser includes a rotatably mounted transfer roller which is moveable against one of the feed rollers in response to substantial depletion of the sheet material on the primary roll. The leading end of the sheet material from the reserve roll is positioned between the transfer roller and the feed rollers while the primary roll is being used. Upon movement of the transfer roller toward the feed rollers, the sheet material from the reserve roll is pressed against the drive roller and the drive roller, as it is turned by an attached crank or lever, advances the reserve sheet material toward the feed roller nip. A prong holding the end of the reserve roll sheet material prevents advancement of the sheet material past the feed rollers and thereby directs the sheet material to crowd into the feed roller nip for dispensing.

Although adequate for a typical rolled paper dispenser, the transfer means as taught by Bastian is not adequate for an embossing dispenser. The sheet crowding disclosed by Bastian of the reserve sheet material is insufficient to produce enough aggregate friction as a result of geometric restrictions to successfully induce the reserve roll of sheet into the nip formed by knuckle-type embossing rollers.

U.S. Pat. No. 4,010,909 also to Bastian teaches a modified transfer device which uses two transfer rollers connected to opposite ends of a pivotally mounted and spring biased linking member. The first transfer roller contacts one feed roller and the second transfer roller contacts the other feed roller thereby bunching the lead sheet of the reserve roll into the nip formed between the feed rollers. Again, due to the geometry of the nip between the embossing rollers of the present invention, successful transfer of the reserve roll sheet material into the nip would not be accomplished by this design of Bastian. The bunching of the sheet material becomes so great before it is pressed into the nip between the knuckled rollers that the resultant wad is too large to crank through the nip.

U.S. Pat. No. 4,487,375 to Rassmussen, et al. teaches a dispenser for sequentially dispensing multiple rolls of paper toweling. Such dispenser includes what are described to be a pair of mating rollers wherein one of the mating rollers includes a plurality of annular recesses. The transfer mechanism includes spaced tucking fingers corresponding with the annular recesses such that, on transfer, the tucking fingers drive the web into the recesses and thus cause the web to engage in the nip.

SUMMARY OF THE INVENTION

Accordingly, it is an object and advantage of the present invention to provide a new and improved sheet material transfer means for sequentially dispensing sheet material of primary and secondary rolls of such sheet material from a dispenser which utilizes knuckled embossing rollers.

It is a further object and advantage of the present invention to provide an improved sheet material transfer means for use with embossing rollers which includes a tucking comb to position the reserve roll sheet material for dispensing into the nip formed between the embossing rollers.

Still another object and advantage of the present invention is to provide an improved sheet material transfer mechanism which provides mean for aligning the prongs of the tucking comb to ensure that as the tucking comb approaches the nip formed between the embossing rollers, such transfer is made without the comb interfering with the embossing rollers.

Briefly stated, the foregoing and numerous other features, objects and advantages of the present invention will become readily apparent upon a reading of the detailed description, claims and drawings set forth hereinafter. The features, objects and advantages are accomplished by incorporating into the embossing dispenser a feeder bar which includes a comb projecting therefrom. The comb is comprised of a series of spaced substantially planar fins which align with the annular grooves between the knuckled discs on one of the rollers. The transfer means includes a spring-biased linkage such that a centering roller is pressed against the primary roll of sheet material. As the primary roll is depleted, the spring biased linkage moves downward in an arcuate path. This results in the movement of the feeder bar toward the nip between the embossing rollers. Shortly before the primary roll is completely spent, the comb of the feeder bar has moved into such a position that the fins thereof have been partially inserted into the grooves of one of the embossing rollers in close proximity to the nip. The sheet material from the secondary roll is thus pressed by the fins of the comb into such grooves where it is engaged by the knuckle of both embossing rollers and is drawn to the nip and dispensed.

To ensure that the fins do not contact the knuckled disks of the embossing rollers, the feeder bar includes a tapered wing extending from each end thereof. As the feeder bar moves toward the nip, the tapered wings engage the outside ends of the embossing portions of the roller thereby precisely positioning the fins in relation to the knuckled disks and annular grooves.

BRIEF DESCRIPTION OF THE DRAWINGS

FIG. 2 is a top plan view of the feeder bar of the present invention.

FIG. 3 is a bottom plan view of the feeder bar of the present invention.

FIG. 4 is a cross sectional view of the feeder bar of the present invention taken along line 4—4 of FIG. 3.

FIG. 5 is an enlarged side elevation of a guide wing of the present invention.

FIG. 6 is a cross sectional view of a guide wing of the present invention taken along line 6—6 of FIG. 5.

DETAILED DESCRIPTION OF THE PREFERRED EMBODIMENT

Figure 1:
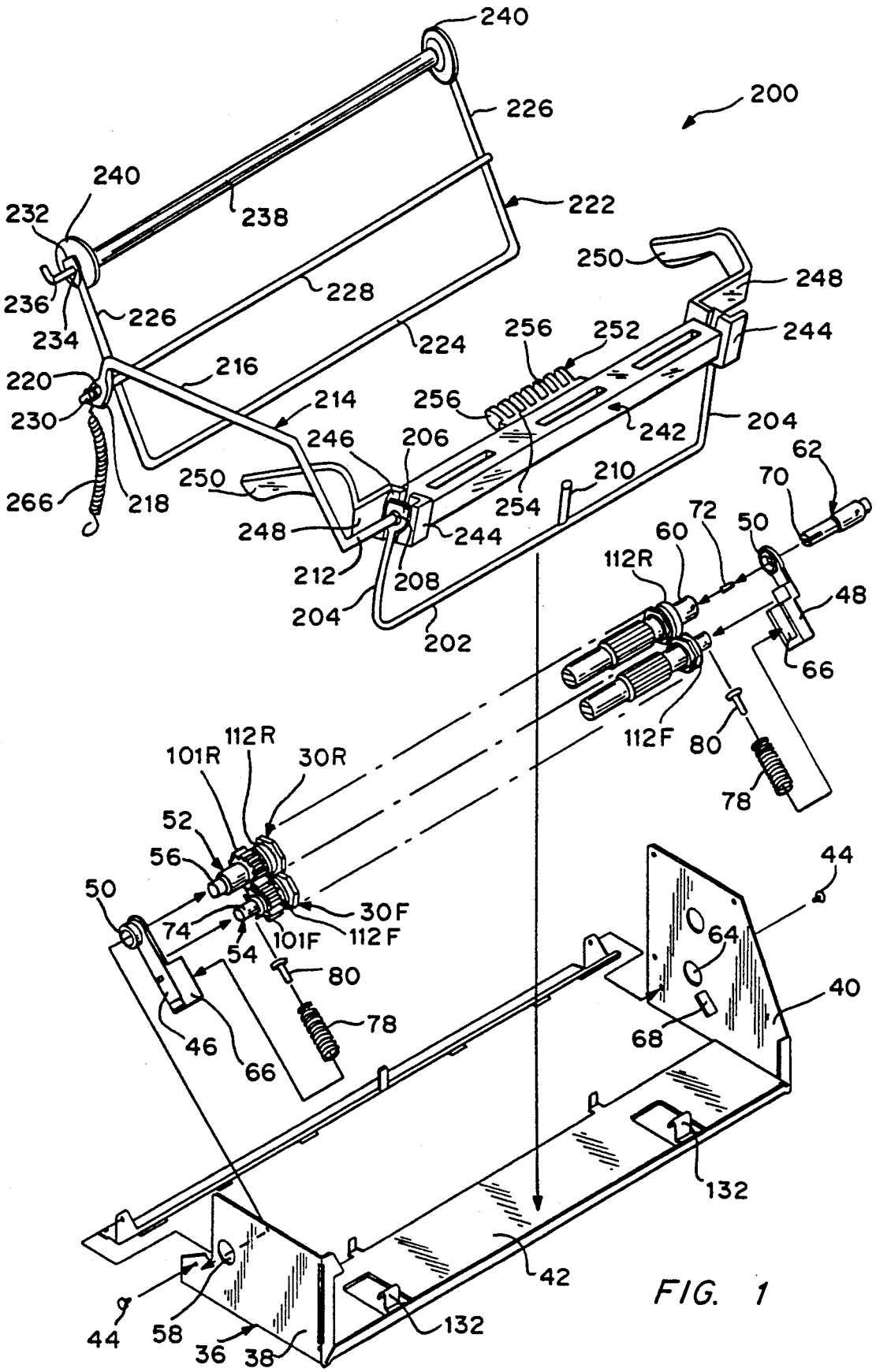
FIG. 1 is an exploded perspective view of the improved transfer mechanism of the present invention shown in combination with some interacting internal elements of an embossing dispenser.

Turning first to FIG. 1, there is shown an exploded perspective view of the improved embossing dispenser roll transfer assembly 200 of the present invention in combination with some of the components of an embossing roll dispenser described in U.S. patent application Ser. No. 07/337,058 now U.S. Pat. No. 5,061,232 filed on Apr. 12, 1989, such application hereby incorporated by reference herein. Those elements identified by numerals below 200 in the figures of this Application are fully described in U.S. patent application Ser. No. 07/337,058 and, therefore, a detailed description of those elements will not be repeated herein.

Transfer assembly 200 includes a front transfer link 202 which is preferably a bent metal bar or rod which is circular in cross section. Front transfer link 202 includes legs 204 with each leg 204 having a flattened tab end portion 206. Each flattened tab end portion 206 has a bore 208 therethrough. Affixed to front end transfer link 202 and extending substantially parallel to legs 204 is secondary web retaining pin 210. Front transfer link 202 is pivotally mounted on frame 36 by means of ears 132.

Extending through bores 208 is the lateral leg 212 of middle transfer link 214. Middle transfer link 214 is also, preferably, a metal bar or a rod which is circular in cross section. Middle transfer link 214 is bent such that there extends back from lateral leg 212 linking leg 216. The distal end of linking leg 216 includes a flattened tab end portion 218 having a bore 220 therethrough.

Pivotally connected to linking leg 216 is back transfer link 222. Back transfer link 222 is also, preferably, made from metal bar stock or rod which is circular in cross section. Back transfer link 222 includes retaining bar 224 which is bent to be substantially in a U-shape having upright legs 226. Extending from one upright leg 226 to the other upright leg 226 and affixed to each of said upright legs 226 is rod 228. Rod 228 includes a projecting end 230 which extends past one of the legs 226 and inserts through bore 220.

Each upright leg 226 of back transfer link 222 includes a flattened tab end portion 232 having a bore 234 therethrough. Extending through bores 234 and retained therein is centering roller axle 236. Rotatably mounted on centering roller axle 236 is centering roller 238. Centering roller 238 is preferably a piece of molded plastic material which is substantially cylindrical, having a bore through the cylindrical axis thereof for receipt of the centering roller axle 236. At each end of centering roller 238 and integrally formed therewith is a guide disk 240. Guide disks 240 may be substantially circular at each base thereof or may be substantially circular with a portion of the circular shape removed along a chord of the circle. Each guide disk 240 is preferably somewhat conical in shape with the conical surfaces facing one another such that the primary roll of paper is urged to a center position therebetween.

Front transfer link 202 with legs 204, middle transfer link 214 and back transfer line 222 connected together comprise the transfer linkage. Such transfer linkage is pivotally connected to the dispenser at two locations within the dispenser.

Mounted on lateral leg 212 between legs 204 of a front transfer link 202 is feeder bar 242. Feeder bar 242 is preferably an integrally molded plastic piece having a central bore for receipt of and retention by lateral leg 212. At each end of feeder bar 242 is a feeder bar orientation block 244. Feeder bar orientation blocks 244 include recesses 246 for receiving flattened tab end portions 206 and legs 204.

Extending outward from feeder bar orientation blocks 244 are plate members 248. Extending back substantially perpendicular to plate members 248 are guide wings 250. Guide wings 250 are substantially arcuate and resemble the ear pieces of a pair of eyeglasses.

Extending from a central portion of feeder bar 242 is comb 252. Comb 252 includes a base plate 254 having a plurality of spaced apart substantially planar fins 256 extending substantially perpendicularly from base plate 254. Feeder bar 242, feeder bar orientation blocks 244, plate members 248, guide wings 250 and comb 252 are preferably integrally formed or molded.

Referring next to FIGS. 2 and 3, it can be seen that guide wings 250 include a bend near the midpoint thereof such that tail portion 258 of each guide wing 250 flares slightly outward or away from the other tail portion 258. At the lower inside face of each guide wing 250, there is a tapered, contact surface 260 which is shown in FIG. 3 and can be viewed in greater detail in FIGS. 5 and 6.

Figure 7:
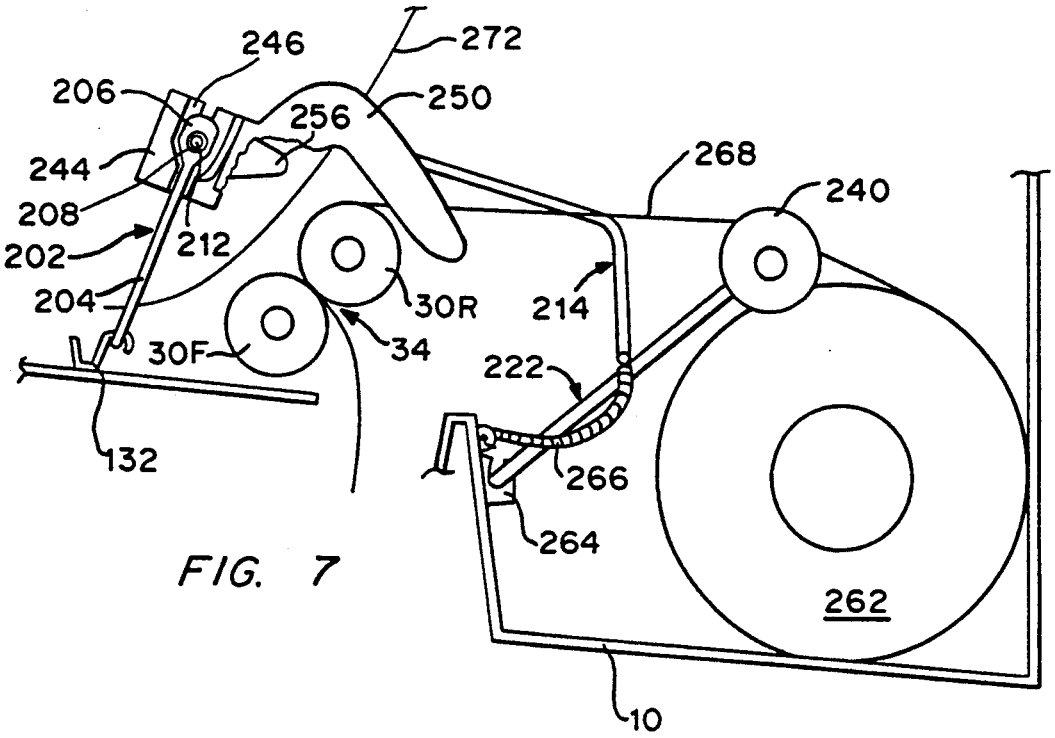
FIG. 7 is a side view schematic of the improved transfer mechanism of the present invention within an embossing dispenser containing a full primary roll.
Figure 8:
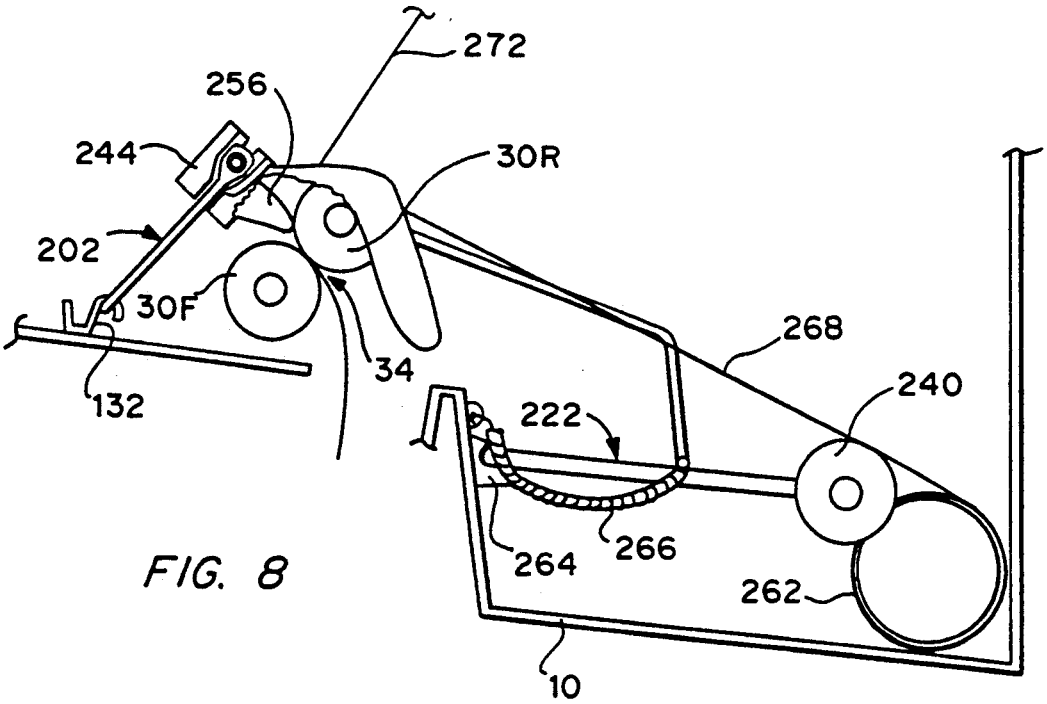
FIG. 8 is a side view schematic of the improved transfer mechanism of the present invention within an embossing dispenser containing a depleted primary roll.
Figure 9:
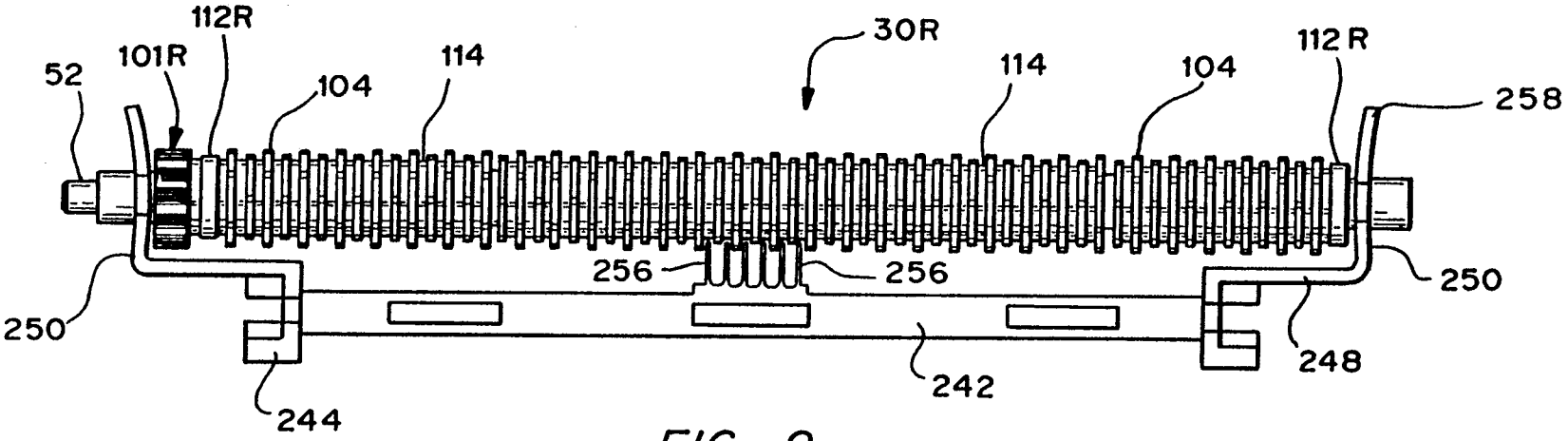
FIG. 9 is a top plan view showing the transfer bar of the present invention in relation to an embossing roller when the primary roll of sheet material is near exhaustion.

FIGS. 7 and 8 represent side view schematics of the transfer assembly or linkage 200 of the present invention mounted within the dispenser described in U.S. patent application No. 07/337,058. A primary roll of sheet material 262 resides at the bottom of cabinet 10. Centering roller (see FIG. 1) 238 presses against primary roll 262 such that primary roll 262 resides between guide disks 240.

As stated above, centering roller 238 is supported on centering roller axle 236 which is part of back transfer link 222. Back transfer link 222 is pivotally mounted within cabinet 10 by means of clip 264. Back transfer link 222 is biased to rotate toward primary roll 262 by means of spring 266.

The sheet material 268 being dispensed from primary roll 262 is deployed over the top of centering roller 238 and into the nip 34 between embossing rollers 30F and 30R before exiting cabinet 10. When primary roll 262 is substantially full, back transfer link 222 is retained in a more elevated position which consequently through middle transfer link 214 maintains the legs 204 of front transfer link 202 in a more erect or upright position. It should be noted that front transfer link 202 is pivotally mounted within cabinet 10 by means of bracket 132. With front transfer link 202 in a more upright position, fins 256 of comb 252 are maintained away from embossing rollers 30F and 30R. As primary roll 262 is depleted, back transfer link 222 pivots downward thereby pulling along middle transfer link 214 which is pivotally connected to back transfer link 222. Similarly, front transfer link 202 which is pivotally connected to middle transfer link 214 is rotated downward or to a more inclined position such that the fins 256 of comb 252 approach embossing rollers 30F and 30R.

In manufacturing the transfer assembly 200 of the present invention, it is important to give the transfer linkage sufficient rotational range of motion to facilitate loading of the primary roll within the dispenser. To load the primary roll, it is necessary to rotate the feeder bar 242 against the force applied by spring 266. This action simultaneously rotates transfer link 222 with centering roller 238 up and away from the spent primary roll. Rotation of back transfer link 222 with centering roller 238 must be sufficient to allow a full primary roll to be placed within the dispenser beneath the back transfer like 222 and centering roll 238. The back transfer link 222 with centering roller 238 can then be allowed to rotate by the force of spring 266 back against the newly inserted primary roll.

The secondary roll (not shown) resides in the upper portion of cabinet 10. In loading the secondary roll, the lead end or tail 272 of the secondary roll is fed down between wings 250 and legs 204. In such manner, the lead end or tail 272 resides between the embossing rollers 30F and 30R and the fins 256 of comb 252. The lead end 272 is impaled upon secondary web retaining pin 210 to maintain the lead end 272 at such position until it is dispensed.

Referring now to FIGS. 7 and 8, note that in both FIGS. 7 and 8, feeder bar orientation block 244 and wing 250 are shown partially cut away so that the fins 256 of comb 252 are visible. As primary roll 262 nears exhaustion (FIG. 8), back transfer link 222 has pivoted far enough and thereby correspondingly rotated front transfer link 202 to the extent that the fins 256 of comb 252 have partially inserted into or invaded the annular grooves 114 of embossing roller 30R in close proximity to nip 34. In such manner, fins 256 have moved tail 272 into contact with embossing roller 30R so that the tail or lead end 272 of the secondary roll is frictionally engaged by the knuckles of embossing roller 30R, torn from secondary web retaining pin 210 and drawn through nip 34 and thereby dispensed.

The assembly 200 should preferably be designed such that primary roll 262 is near depletion when dispensing begins from the secondary roll. In such manner, both webs 268 and 272 will briefly be dispensed through nip 34 until primary roll 262 becomes fully depleted. This ensures that there will be no interruption of dispensing between the primary roll 262 and the secondary roll.

As comb 252 is moved toward embossing roller 30R, it is important to precisely locate the fins 256 such that they do not engage or contact the embossing disks 104 or the hub portion 102 residing at the bottom of each annular groove 114. It is equally important to limit the amount of rotation of comb 252 in that the fins 256 occupy the same annular grooves 114 as do the embossing disks of roller 30F. In such manner, if comb 252 were allowed to rotate down too far into nip 34, the fins 256 would engage the embossing disks 104 of embossing roller 30F with potentially destructive results. Wings 250 serve the dual purpose of precisely positioning feeder bar 242 and limiting the lateral movement thereof so that the fins 256 of comb 252 must move into the grooves 114 without contacting the embossing disks 104 or the hub portion 102 while simultaneously limiting the amount of rotation which can be imparted by front transfer link 202 to comb 252.

The gap between the inside faces of wings 250 is only slightly larger than the length of the plastic embossing portions of embossing roller 30R which includes gear 101. As front transfer link 202 pivots downward, guide wings 250 move toward embossing roller 30R. The bend in guide wings 250 ensures that the first contact made between guide wings 250 and gear 101 on one end of embossing roller 30R and the plastic embossing portion on the opposite end of embossing roller 30R will be the inside face of wings 250 and not the bottom edge thereof. This prevents guide wings 250 from hanging up on the embossing roller 30R. Similarly, the tapered contact surface 260 promotes the movement of guide wings 250 once contacting any portion of embossing roller 30R to move outward or axially away from embossing roller 30R so that upon full depletion of the primary roll 262, the bottom edge of guide wings 250 is supported on the metal axle 52 of the embossing roller with the inside faces of wings 250 immediately adjacent the gear 101 on one end and the edge of the plastic embossing portion on the opposite end. Thus, even though feeder bar 242 is allowed some freedom of lateral movement along lateral leg 212, each time feeder bar 242 moves into close proximity with the embossing rollers, guide wings 250 precisely position feeder bar 242 so that the fins 256 of comb 252 enter the annular grooves 114 of the embossing roller 30R thereby initiating dispensing of the secondary roll without interfering with either embossing roller 30R, 30F.

From the foregoing, it will be seen that this invention is one well adapted to obtain all of the ends and objects hereinabove set forth together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A transfer apparatus for use with an embossing dispenser which includes a cabinet, means for supporting a primary roll of sheet material within the cabinet, means for supporting a secondary roll of sheet material within the cabinet, and a nip between two embossing rollers, each of the embossing rollers including a plurality of disks and annular grooves arranged in alternating relationship, said transfer apparatus feeding sheet material from the reserve roll into the nip between the two embossing rollers when the primary roll of sheet material nears exhaustion, said transfer apparatus comprising:

(a) a front transfer link pivotally mounted within the cabinet;

(b) a middle transfer link pivotally connected to said front transfer link;

(c) a back transfer link having proximal and distal ends, said proximal end being pivotally mounted within the cabinet, said back transfer link being pivotally connected to said middle transfer link away from said proximal end;

(d) a feeder bar attached to said front transfer link, said feeder bar including a comb means projecting therefrom and a wing member extending from each end thereof;

(e) a primary roll contacting surface located at the distal end of said back transfer link, said back transfer link biased for rotational movement toward the primary roll so that said primary roll contacting surface maintains contact with the primary roll as the primary roll is depleted thereby causing said front transfer link to simultaneously rotate to move said feeder bar toward the embossing rollers, said wing members engaging one of said embossing rollers as the primary roll nears exhaustion to thereby position said comb means to partially invade the grooves of that embossing roller.

2. A transfer apparatus for use with an embossing dispenser which includes a cabinet, means for supporting a primary roll of sheet material within the cabinet, means for supporting a secondary roll of sheet material within the cabinet, and a nip between two embossing rollers, each of the embossing rollers including a plurality of disks and annular grooves arranged in alternating relationship, said transfer apparatus feeding sheet material from the reserve roll into the nip between the two embossing rollers when the primary roll of sheet material nears exhaustion, said transfer apparatus comprising:

(a) transfer linkage pivotally mounted within the cabinet, said transfer linkage supporting a primary roll contacting surface;

(b) a bar means attached to said transfer linkage, said bar means including a comb means projecting therefrom and a wing member extending from each end thereof, said transfer linkage biased for rotational movement to maintain said roll contacting surface in contact with the primary roll as the primary roll is depleted thereby simultaneously rotating said bar means toward the embossing rollers, said wing members engaging one of embossing rollers as the primary roll nears exhaustion to thereby position said comb means to partially invade the grooves of that embossing roller.

3. A transfer apparatus as recited in claim 2 further comprising:

pin means within the dispenser for holding a tail of the secondary roll between the embossing rollers and said bar means.

4. A transfer apparatus as recited in claim 2, said comb means further comprising:

a plurality of spaced apart, substantially parallel fin members.

5. A transfer apparatus as recited in claim 2, each of said wing members including:

outwardly flared tail portions.

6. A transfer apparatus as recited in claim 5, each of said wing members further including:

a tapered contact surface for engaging the embossing roller and positioning said guide bar with respect to the embossing roller.

7. A transfer apparatus as recited in claim 2 wherein said transfer linkage comprises:

(a) a front transfer link pivotally mounted within the dispenser;

(b) a middle transfer link pivotally connected to said front transfer link;

(c) a back transfer link having proximal and distal ends, said proximal end being pivotally mounted within the dispenser, said back transfer link being pivotally connected to said middle transfer link away from said proximal end, said roll contacting surface located at the distal end of said back transfer link, said bar means connected to said front transfer link.

8. A transfer apparatus as recited in claim 2 wherein said roll contacting surface includes:

a guide disk on each end thereof to thereby maintain the primary roll centered between said guide disks.

9. A transfer apparatus as recited in claim 2 further comprising:

pin means within the dispenser for holding a tail of the secondary roll between the embossing rollers and said bar means.

10. In combination with an embossing dispenser for dispensing primary and secondary rolls of sheet material through a pair of embossing rollers, the embossing rollers including a plurality of disks and annular grooves arranged in alternating relationship, a transfer apparatus for feeding sheet material from the reserve roll into the nip between the two embossing rollers when the primary roll of sheet material nears exhaustion, said transfer apparatus comprising:

(a) transfer linkage pivotally mounted within the cabinet, said transfer linkage supporting a roll contacting surface;

(b) a bar means attached to said transfer linkage, said bar means including a comb means projecting therefrom and a wing member extending from each end thereof, said transfer linkage biased for rotational movement to maintain said roll contacting surface in contact with the primary roll as the primary roll is depleted thereby simultaneously rotating said bar means toward the embossing rollers, said wing members engaging one of embossing rollers as the primary roll nears exhaustion to thereby position said comb means to partially invade the grooves of that embossing roller.

11. A transfer apparatus for use with an embossing dispenser for dispensing primary and secondary rolls through a pair of embossing rollers, each of the embossing rollers including a plurality of disks and annular grooves arranged in alternating relationship, said transfer apparatus feeding sheet material from the reserve roll into the nip between the two embossing rollers when the primary roll of sheet material nears exhaustion, said transfer apparatus comprising:

(a) transfer linkage pivotally mounted within the cabinet, said transfer linkage supporting a roll contacting surface;

(b) a bar means attached to said transfer linkage, said bar means including a comb means projecting therefrom and a wing member extending from each end thereof, said transfer linkage biased for rotational movement to maintain said roll contacting surface in contact with the primary roll as the primary roll is depleted thereby simultaneously rotating said bar means toward the embossing rollers, said wing members engaging one of embossing rollers as the primary roll nears exhaustion to thereby position said comb means to partially invade the grooves of that embossing roller.

12. A transfer apparatus as recited in claim 11 further comprising:

pin means within the dispenser for holding a tail of the secondary roll between the embossing rollers and said bar means.

13. A transfer apparatus as recited in claim 12 wherein: said pin means extends from said transfer linkage.

14. A transfer apparatus as recited in claim 11, said comb means further comprising:

a plurality of spaced apart, substantially parallel fin members.

15. A transfer apparatus as recited in claim 11, each of said wing members including:

outwardly flared tail portions.

16. A transfer apparatus as recited in claim 15, each of said wing members further including:

a tapered contact surface for engaging the embossing roller and positioning said guide bar with respect to the embossing roller.

17. A transfer apparatus as recited in claim 11 wherein said transfer linkage comprises:

(a) a front transfer link pivotally mounted within the dispenser;

(b) a middle transfer link pivotally connected to said front transfer link;

(c) a back transfer link having proximal and distal ends, said proximal end being pivotally mounted within the dispenser, said back transfer link being pivotally connected to said middle transfer link away from said proximal end, said roll contacting surface located at the distal end of said back transfer link, said bar means connected to said front transfer link.

18. A transfer apparatus as recited in claim 11 wherein said roll contacting surface includes:

a guide disk on each end thereof to thereby maintain the primary roll centered between said guide disks.

* * * * *